United States Patent [19]

Abbasov et al.

[11] Patent Number: 4,979,489

[45] Date of Patent: Dec. 25, 1990

[54] METHOD AND APPARATUS FOR BREAKING REINFORCED CONCRETE PILES AND FOR EXPOSING REINFORCING BARS

[76] Inventors: Pulat A. Abbasov, prospekt Krasnogo Znameni, 101, kv. 81; Valentin E. Abramov, Oreansky prospekt, 97, kv. 61, both of Vladivostok; Dmitry A. Trifonov-Yakovlev, Ostozhenka 1, kv. 22, Moscow; Lev V. Erofeev, Jurievsky pereulok, 22, korpus 2, kv. 37, Moscow; Gennady S. Kuritsyn, Leninsky prospekt, 129, korpus 3, kv. 145, Moscow; Alexandr P. Borodachev, prospekt Mira, 5, kv. 39; Viktor V. Matvienko, ulitsa Przhevalskogo, 2I, kv. 22, both of Orenburgskaya oblast, Orsk; Jury V. Dmitr Evich, ulitsa Chicherina, 2/9, kv. II; Ljudmila P. Lukash, Schelkovskoe schosse, 9I/I, kv. I52, both of Moscow; Alexandr S. Petrashen, ulitsa Leninskava, I9I, kv. 4, Vladivostok; Valery B. Petrov, pereulok Dunaevskogo, 3I, kv. 48, Orenburgskava oblast, Orsk, all of U.S.S.R.

[21] Appl. No.: 392,971

[22] PCT Filed: May 23, 1988

[86] PCT No.: PCT/SU88/00114

§ 371 Date: Aug. 2, 1989

§ 102(e) Date: Aug. 2, 1989

[87] PCT Pub. No.: WO89/05380

PCT Pub. Date: Jun. 15, 1989

[51] Int. Cl.[5] ..... B28D 1/00

[52] U.S. Cl. ..... 125/23.01; 405/232; 405/303

[58] Field of Search ..... 405/232, 227, 228, 303, 405/231, 246, 247; 125/23 R, 23 C, 23 T, 16 R, 14; 83/694, 198; 225/102; 30/241

[56] References Cited

U.S. PATENT DOCUMENTS

| | | | |
|---|---|---|---|
| 3,056,267 | 10/1962 | McRee | 405/228 |
| 3,727,599 | 4/1973 | Sugiki et al. | 125/23 R |
| 4,124,015 | 11/1978 | Isaksson | 125/23 R |
| 4,180,047 | 12/1979 | Bertelson | 405/232 X |
| 4,197,828 | 4/1980 | Schellhorn | 125/23 C |

FOREIGN PATENT DOCUMENTS

| | | |
|---|---|---|
| 0051837 | 5/1982 | European Pat. Off. . |
| 2713613 | 10/1977 | Fed. Rep. of Germany . |
| 2488633 | 2/1982 | France . |
| 897954 | 1/1982 | U.S.S.R. . |

*Primary Examiner*—Dennis L. Taylor

*Attorney, Agent, or Firm*—Fleit, Jacobson, Cohn, Price, Holman & Stern

[57] ABSTRACT

A method is characterized by clamping a pile above and below a break-off line with simultaneous undercutting of the pile along the break-off line.

An apparatus for carrying out the method has an upper power frame (1) and a lower power frame (3) positioned one above the other and connected to each other by means of hydraulic breaking cylinders (2). The power frames (1, 3) are made up of blocks (6, 11) defining a closed figure and pivotally connected to one another by means of hydraulic clamping cylinders (7, 13). The axes of the hydraulic cylinders (7, 13) run perpendicularly with respect to the longitudinal axis of the pile.

4 Claims, 3 Drawing Sheets

METHOD AND APPARATUS FOR BREAKING REINFORCED CONCRETE PILES AND FOR EXPOSING REINFORCING BARS

FIELD OF THE ART

The invention relates to the construction engineering field and in particular, it deals with a method and apparatus for breaking reinforced concrete piles and for exposing reinforcing bars.

The invention may be used in civil engineering, in industrial and water power construction and in other fields for breaking off parts of reinforced concrete piles that are not driven to a preset depth and protrude from the ground level and also for exposing reinforcing bars of the pile left in the soil for subsequent erection of buildings and other installations on the piles.

The method according to the invention makes it possible to break off parts of reinforced concrete piles protruding from the soil simultaneously with the exposure of their reinforcing bars so as to ensure an even surface of the end face of the pile at the point of breakage below the exposed parts of reinforcing bars with complete elimination of manual labour and any auxiliary devices.

STATE OF THE ART

Various methods are known and used to remove underdriven parts of reinforced concrete piles and to expose reinforcing bars of the piles left in the soil. Most widely used up to now is breaking concrete with a pick hammer, with subsequent cutting of reinforcing bars using oxyacetylene or oxygen-gasoline cutters. Concrete breakage and reinforcing bars exposure are carried out in a small zone at a level 20–30 cm above a present level of concrete of the pile left in the soil so as to break down concrete to the present level and to expose the reinforcing bars to a desired length after cutting through the exposed portion of the reinforcing bars using one of the abovementioned methods.

This method results in a low productivity and high power requirements (hence high cost) and in the need to use a hoisting gear (lifting crane or the like) in addition to a compressor with a pick hammer and an oxyacetylene or oxygen-gasoline cutter for holding the part of the pile being removed so as to avoid its fall-down during the removal.

Also known in the art are methods and apparatus that allow the process of removal of the pile protruding from the soil to be mechanized. One of such methods comprises crushing concrete of the underdriven part of the pile protruding from the soil by applying transverse forces to the pile (with respect to the longitudinal axis of the pile). This method is carried out by means of mechanical devices in the form of a rigid frame having a hole in the central portion and hydraulic jacks mounted opposite to each other in two mutually perpendicular planes. Wedges are provided on movable parts of the jacks facing inwardly into the frame. The jacks are operated by a self-contained pumping plant through high-pressure flexible hoses.

The device is installed on a pile at the top using a hoisting gear, and concrete is crushed by means of the hydraulic jacks with gradual lowering of the device down to a level at which the pile is to be left in the soil. After crushing the concrete, the deformed reinforcing bars are cleaned fron concrete manually or using pick hammers, and the reinforcing bars are cut off at the desired level at a preset distance from the end face of the pile left in the soil.

This method also results in a low productivity, the productivity decreasing with an increase in the length of the portion of the pile over the soil level to be removed. In addition, this method also calls for the employment of both pick hammer, manual labour and oxyacetylene cutters (oxygen-gasoline cutters) and cannot ensure the intactness of the end face of the pile left in the soil. The device for carring out the method contains large quantity of metal because it has a rigid load-bearing frame taking up substantial bending forces.

Another method for a mechanized removal of underdriven parts of reinforced concrete piles is based on the application to a pile of oppositely directed torques about the longitudinal axis of the pile above and below a preset level, respectively which, owing to a low shear strength of concrete, can ensure concrete breakage at a level intermediate the points of application of torques and exposure of the reinforcing bars which are then cut by means of an oxyacetylene or oxygen-gasoline cutter.

This method is carried out by means of an apparatus consisting of two planar frames having a T-section in the plan view which are mounted on each other for relative rotation in a horizontal plane (SU, A, 440475).

The frames are connected to each other by means of a hydraulic jack in such a manner that grooves of the upper and lower frames be brought in registry in a vertical plane when the piston rod of the hydraulic cylinder is in one limit position, the frames being turned with respect to each other at a certain angle when the piston rod is in the other limit position to ensure torsion of the pile concrete in a plane drawn at a point of contact between the upper and lower frames. The hydraulic cylinder is operated by means of a pumping plant which is generally installed on the upper frame.

The pumping plant comprises an oil tank with filters, an electric motor, a pump and piping. The apparatus suspended from a lifting crane is brought near the pile laterally so that the level at which the pile should be cut be located between the upper and lower frames and one of the pile facets bear against the rear wall of the aligned grooves of the upper and lower frames.

During movement of the piston rod of the hydraulic cylinder, the upper frame is rotated with respect to the lower frame which is connected to the pile driven into the soil, and concrete is broken in the plane drawn between the frames with a certain deformation (torsion) of the pile reinforcing bars. To avoid fall-down of the top part of the pile after breakage of concrete, it is held by means of a second lifting crane. After the twisting, the apparatus is removed from the pile, and the reinforcing bars are cut off and cleaned from remaining concrete, and the upper end face of the pile left in the soil is evened out.

The apparatus for carrying out the abovedescribed method is simple, but two lifting cranes should be used for carrying out the method. In addition, concrete of the pile may be broken below the torsion plane as well, and reinforcing bars should be cut using some method with the employment of manual labour.

DISCLOSURE OF THE INVENTION

It is an object of the invention to eliminate the abovementioned disadvantage.

The invention is based on the problem of providing a method for removing underdriven parts of piles protruding from the soil by breaking them and exposing reinforcing bars, which ensures the intactness of the end faces of the reinforced concrete pile and exposure of the reinforcing bars to a preset length while eliminating manual labour and enhancing productivity and also of providing an apparatus for carrying out this method which is easy to manufacture and is highly reliable in operation.

This problem is solved in a method for breaking reinforced concrete piles and for exposing reinforcing bars, comprising clamping the pile above and below a break-off line and applying tensile forces in a direction perpendicular with respect to the clamping forces, in that according to the invention, the pile is undercut along the break-off line simultaneously with the clamping.

This problem is also solved by means of an apparatus for carrying out the method, comprising upper and lower power frames positioned one above the other and connected to each other by means of hydraulic breaking cylinders having their axes running in parallel with the longitudinal axis of the pile, wherein, according to the invention, the power frames are made up of blocks defining a closed figure and pivotally connected to one another by means of hydraulic clamping cylinders having their axes running perpendicularly with respect to the longitudinal axis of the pile.

It is preferred that each block have guide members in the form of two pairs of parallel plates cantilevered to the lateral faces of the blocks in such a manner that the distal ends of the guide members of the adjacent blocks extend one above the other in parallel planes.

One embodiment of the invention provides that each block of the lower power frame has at leat one projection provided on the inner surface of the block and that the upper face of each block of the upper power frame has a leg supporting a device for suspending the apparatus.

To ensure the intactness of the end faces of the pile being broken, the blocks clamping the pile are pivotally connected to the hydraulic clamping cylinders so as to define a closed figure having a configuration strictly conforming to the outlines of the cross-section of the pile in such a manner that the blocks intimately engage the surface of each facet to avoid deformation of reinforcing bars in the pile when the longitudinal breaking force is applied and to ensure the intactness of the end face of the pile.

To ensure the exposure of the reinforcing bars on the part of the pile left in the soil, projections are provided in the lower part of the inner face of each block of the lower power frame, the projections undercutting concrete of the pile during clamping of the pile with the blocks on each facet so that the reinforcing bars are clamped along a length equal to the height of the block of the lower power frame when the apparatus is removed from the pile.

To ensure a productivity which is at least three times as high as with any of the prior art methods and to avoid employment of manual labour and any auxiliary mechanical devices, tension (with subsequent breakage) of concrete is used, since the tensile strength of concrete is substantially lower than any other strength (compressive, shear, and the like).

To ensure safety of operation, the apparatus is provided with legs mounted on the upper power frame and having means for suspending the apparatus so as to hold the broken part of the pile and transfer it after the pile breakage to a stockpile location or vehicle by means of a hoisting gear which is used with the apparatus.

The method according to the invention and its implementation in the apparatus according to the invention ensure enhanced productivity which is 3–5 times as great in comparison with any other prior art method and make it possible to ensure the necessary savings.

The invention essentially resides in the following.

The tensile strength of concrete is known to be ten times as low as its compressive strength.

The abovementioned existing methods for breaking concrete carried out by means of apparatuses for breaking off underdriven parts of piles are based on applying compressive or shearing forces, whereas the method according to the invention is based on the application of tensile forces to concrete, the forces being much lower than those required when concrete is to be broken by crushing or shearing.

It is necessary to apply much greater forces for breaking reinforcing bars of the pile which are made of round or deformed sections. High compressive strength of concrete makes it possible to clamp the pile along the perimeter with such a force using the method according to the invention so as to "anchor" the reinforcing bars in the concrete and to eliminate its deformation above and below the breakoff line. Investigations were conducted to find minimum clamping forces that can ensure compliance with the abovementioned requirements.

Application of the necessary forces applied uniformly to each facet of a reinforced concrete pile which is generally in the form of a irregular quadrangle in the crosssection is ensured by the provision of a power frame which is in the form of an articulated closed figure.

The employment of the apparatus functioning as described above makes it possible to remove underdriven parts of reinforced concrete piles protruding from the soil with a productivity which is at least three times as high as productivity of any prior art apparatus and to ensure an even surface of the end face of the pile left in the soil with the exposure of reinforcing bars above the end face of the pile if necessary without using any auxiliary devices and ruling out employment of manual labour.

BRIEF DESCRIPTION OF THE DRAWINGS

For a better understanding of the invention, the following description will be given with reference to the accompanying drawings of an apparatus for breaking reinforced concrete piles and exposing reinforcing bars, in which.

PREFERRED EMBODIMENT OF THE INVENTION

Figure 1:
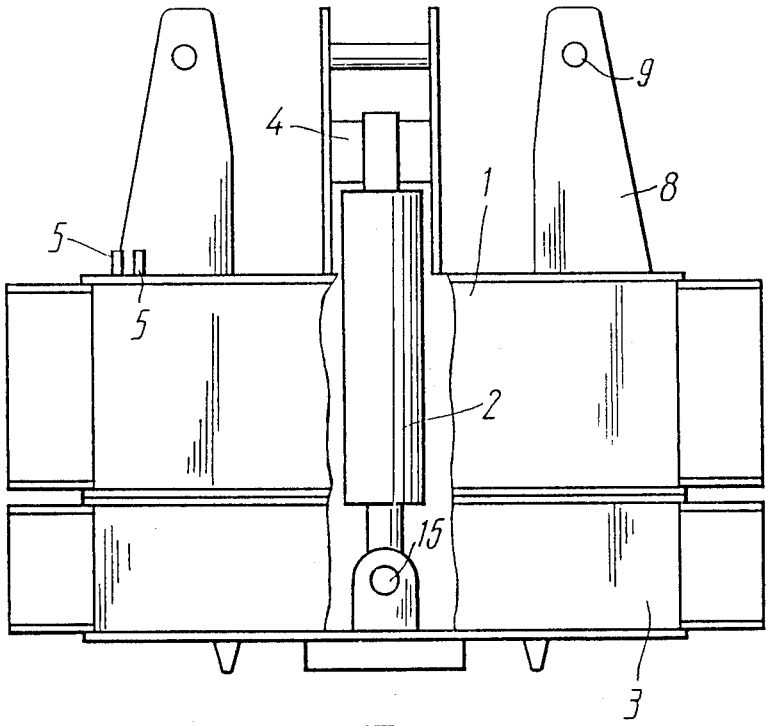
FIG. 1 is a general elevational view of an apparatus according to the invention.
Figure 2:
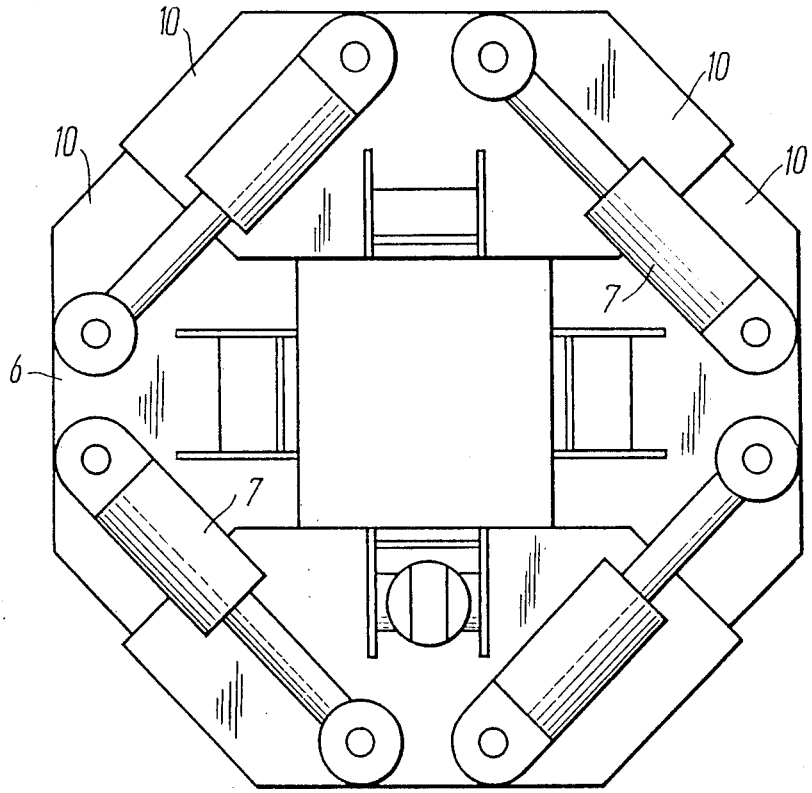
FIG. 2 is a plan view of an upper power frame with legs.

An apparatus shown in the drawings comprises an upper power frame I (FIG. 1) connected by means of four hydraulic breaking cylinder 2 to a lower power frame 3. The hydraulic cylinders 2 are connected to the upper power frame I by means of pins 4. Pressure and discharge pipes 5 are provided in the top of the power frame 1 and are connectible to pressure and discharge lines of a pumping plant (not shown). The upper power frame 1 (FIG. 2) consists of four blocks 6 connected to one another by means of hydraulic clamping cylinders 7 having their axes running perpendicularly with respect to the longitudinal axis of the pile. A leg 8 is provided on the upper face of each block 6 to support a device 9 for suspending and moving the apparatus.

Guide members 10 are provided on lateral faces of each block 6 and comprise two pairs of parallel plates secured to the blocks in such a manner that the plates of the adjacent blocks are positioned above one another in parallel planes. The plates are rigidly cantilevered to the lateral faces of the blocks.

The lower power frame 3 (FIG. 3) also consists of four blocks 11 having guide members 12 made up of parallel plates engaging each other between the adjacent blocks. The blocks 11 are pivotally connected to each other by means of hydraulic clamping cylinder 13. Projections 14 having their axes running perpendicularly with respect to the longitudinal axis of the pile are provided on the inner faces of each block 11, in the lower part thereof.

Piston rods of the vertical breaking cylinders 2 are attached to a middle part of each block 11 by means of a pin 15 (FIG. I).

The abovedescribed apparatus functions in the following manner. The apparatus is suspended from a hook of a hoisting gear and connected to a pumping plant thereof (or to a self-contained pumping plant) and is brought to a position in which the hydraulic clamping cylinders 7, I3 of the upper and lower power frames 1, 3 are spaced apart with a maximum distance between the blocks 6, 11, the hydraulic breaking cylinders 2 being moved closer to each other in such a manner that the upper and lower power frames engage each other. The apparatus is put at the top in this position and is lowered down to a desired level.

Piles can be broken using the above described apparatus in three different ways as will be described below.

METHOD 1

Pile breaking without exposure of reinforcing bars

In this case the apparatus is lowered down along the pile to a position in which a preset break-off line is aligned with the joint between the upper and power power frames. The hydraulic clamping cylinders are then actuated by supplying fluid to their piston rod chambers. After clamping the pile by supplying fluid to the piston chambers of these cylinders, the hydraulic breaking cylinders are actuated to space apart the upper and lower power frames. After the breakage of the pile with the reinforcing bars, the hydraulic breaking cylinders are stopped, and the hydraulic clamping cylinders of the lower power frame are actuated by supplying fluid to their piston chambers so as to release the blocks of the lower power frame. After the blocks of the lower power frame are released, the apparatus is raised together with the broken-off part of the pile clamped in the upper power frame by means of a hoisting gear and is transferred to a stockpile location or into a vehicle. The pile having an even upper end face remains in the soil. The provision of the upright legs on the upper power frame and points of suspension of the apparatus located high on these legs rules out tilting of the apparatus after it has been removed from the pile left in the soil. The cycle is repeated with a next pile.

The projections of the lower blocks (FIG. 3) are removed for operation using this method.

METHOD 2

Pile breaking with the exposure of reinforcing bars

Piles may be broken using method 2 in two different ways.

VERSION 1

The apparatus is put on the pile at the top with the initial position of the hydraulic clamping and breaking cylinders and is positioned at a level such that the break-off line be aligned with the projections of the lower power frame. The pile with reinforcing bars is clamped and broken as described above for Method 1. The apparatus us then removed from the pile by means of a hoisting gear after the blocks of the lower power frame have been released. As the projections of the lower power frame undercut concrete during clamping of the pile at the level spaced from the break-off line at a distance equal to the height of block of the lower power frame, a part of concrete clamped by the lower blocks is shorn off the reinforcing bars when the apparatus is raised, and the pile left in the soil has an even concrete surface on the end faces thereof and bare reinforcing bars of a length equal to the height of the lower block. The broken-off part of the pile is transferred as described for Method 1.

VERSION 2

The apparatus is put on the pile in a position in which the desired break-off line is aligned with the lower edges of the blocks of the lower power frame, whereafter the pile and reinforcing bars are broken as described for Method 1.

After the release of the upper and lower blocks by supplying fluid to the piston chambers of the hydraulic cylinders connecting the blocks to one another, the upper and lower power frames are moved closer to each other by supplying fluid to the piston rod chambers of the hydraulic breaking cylinders. The apparatus mounted on the pile is lowered down ar 25–30 cm together with the broken part of the pile located between the legs and blocks of the upper power frame, and the clamping and breaking steps are repeated. In this case, owing to the fact that the blocks of the upper power frame clamp only the top part of the pile left in the soil at a distance of 25–30 cm from the primary break-off line, no breakage of the reinforcing bars will occur, and only concrete is broken, and the part of the pile clamped in the blocks of the upper power frame is removed from the reinforcing bars to leave in the soil the pile having an even upper end face and the bare reinforcing bars protruding therefrom. The broken-off part of the pile is then transferred as described for Method 1.

Figure 3:
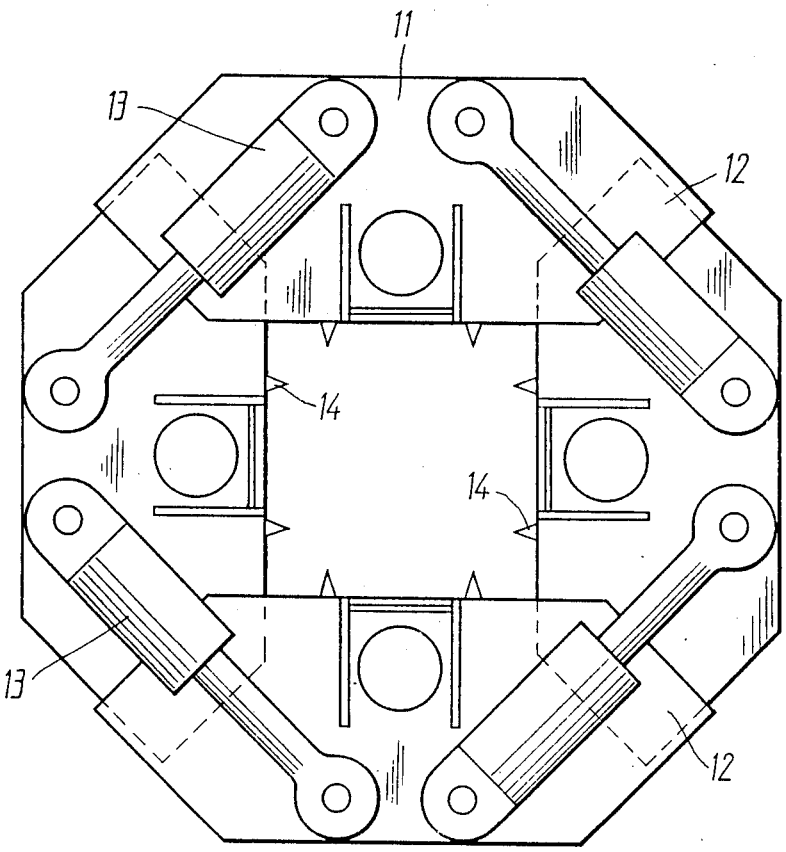
FIG. 3 is a plan view of a lower power frame with projections.

The projections of the lower blocks are removed for operation by this method (FIG. 3).

It will be apparent from the above description that the method and apparatus according to the invention for breaking reinforced concrete piles and for exposing reinforcing bars allow the removal of the underdriven parts of piles protruding from the soil to be carried out with or without the exposure of reinforcing bars of the piles without using manual labour, will full safety of operation, including the transfer of the removed part of the pile, all operations being carried out several times faster than with conventional techniques.

INDUSTRIAL APPLICABILITY

The method and apparatus according to the invention may be efficiently used in the construction where use is made of reinforced concrete piles for subsequent creation of footings of buildings and other installations.

What is claimed is:

1. A method for breaking reinforced concrete piles and for exposing reinforcing bars, comprising, using respective clamping means for clamping the pile above and below a break-off line and applying separating forces to the clamping means in a manner applying tensile forces lengthwise to the pile effective for breaking the pile, CHARACTERIZED in that the pile is undercut along the breaking line simultaneously with the clamping of the pile.

2. An apparatus for breaking reinforced concrete piles, comprising an upper frame (1) and a lower power frame (3) positioned one above the other and connected to each other by means of hydraulic breaking cylinders (2) having axes disposed for running in parallel with the longitudinal axis of the pile, characterized in that the power frames (1, 3) are made up of blocks (6, 11) defining a closed figure and pivotally connected to one another by means of hydraulic clamping cylinders (7, 13) having axes disposed for running perpendicularly with respect to the longitudinal axis of the pile.

3. An apparatus according to claim 2, characterized in that each block (6, 11) has guide members (10, 12) comprising two pairs of parallel plates rigidly cantilevered to lateral faces of the blocks (6, 11) in such a manner that the distal ends of the guide members (10, 12) of the adjacent blocks (6, 11) are located one above the other in parallel planes.

4. An apparatus according to claim 2, characterized in that each block (11) of the lower power frame (3) has at least one projection (14) provided on the inner face of the block (11), and in that the upper face of each block (6) of the upper power frame (1) has a leg (8) supporting a device (9) for suspending the apparatus.

* * * * *